US008613118B1

(12) United States Patent
Boos

(10) Patent No.: US 8,613,118 B1
(45) Date of Patent: Dec. 24, 2013

(54) MOTORIZED SELF PROPELLED BABY HAMMOCK

(76) Inventor: John Sydney Boos, Whitby (CA)

( * ) Notice: Subject to any disclaimer, the term of this patent is extended or adjusted under 35 U.S.C. 154(b) by 17 days.

(21) Appl. No.: 13/371,992

(22) Filed: Feb. 13, 2012

(51) Int. Cl.
*A47D 9/02* (2006.01)

(52) U.S. Cl.
USPC ..... 5/108; 5/109; 5/98.3; 5/105

(58) Field of Classification Search
USPC ..... 5/98.3, 101–109, 127, 128, 130
See application file for complete search history.

(56) References Cited

U.S. PATENT DOCUMENTS

| | | | | | |
|---|---|---|---|---|---|
| 643,267 | A * | 2/1900 | Grimmett | 185/38 |
| 1,227,984 | A * | 5/1917 | Vanderburgh | 5/101 |
| 1,389,682 | A * | 9/1921 | Melniker | 5/98.3 |
| 1,414,027 | A * | 4/1922 | Lannigan | 5/94 |
| 1,435,148 | A * | 11/1922 | Burns | 5/98.3 |
| 4,205,406 | A | 6/1980 | Wangkeo | |
| 4,375,110 | A | 3/1983 | Murphy | |
| 4,996,732 | A * | 3/1991 | Chang | 5/101 |
| 5,035,012 | A * | 7/1991 | Westrich | 5/139 |
| 5,553,337 | A | 9/1996 | Lin | |
| 7,159,254 | B1 | 1/2007 | Voorting | |
| 7,234,177 | B1 | 6/2007 | Drevitson | |
| 7,861,337 | B1 * | 1/2011 | Patel et al. | 5/108 |
| 2007/0113337 | A1 | 5/2007 | Hug et al. | |
| 2008/0060129 | A1 * | 3/2008 | Massa | 5/104 |

* cited by examiner

*Primary Examiner* — Michael Trettel
(74) *Attorney, Agent, or Firm* — KB Patents; Luca D'Ottone

(57) ABSTRACT

The present invention is an electric hammock for babies that can be activated and controlled electronically. The child can be placed securely in the hammock and softly rocked to sleep, without manual application. The hammock provides a soothing motion that is helpful in lulling a baby to sleep. This idea is especially helpful for busy mothers who do not have enough hours in the day to keep up with all that motherhood entails.

17 Claims, 4 Drawing Sheets

MOTORIZED SELF PROPELLED BABY HAMMOCK

REFERENCE TO RELATED APPLICATIONS

The present application claims priority from U.S. Provisional Application No. 61/422,693 to John Boos directed to a Motorized Self Propelled Baby Hammock filed with the USPTO on Dec. 14, 2011.

STATEMENT OF FEDERALLY SPONSORED RESEARCH

The invention disclosed in the present application was not developed with in connection with any fund, loans, or grants originated by or related to the U.S. Federal Government.

BACKGROUND OF THE INVENTION

1. Field of the Invention

This invention generally relates to an assembly used with a suspended hammock and more in particular to an automatic hammock for babies that can be activated and controlled electronically.

2. Brief Description of the Prior Art

Various hammock devices have been described in the prior art to be used as baby bouncers but despite all the efforts listed in the prior art, to the best knowledge of applicant no one describe structures that are swinging baby hammocks insofar the structures disclosed by prior art patents are not truly convenient or else involve complicated, expensive, and overly difficult assembly and/or disassembly parts and procedures. Other devices have been advertised on various media but never patented or described into a printed publication.

SUMMARY OF THE INVENTION

The present invention is an automatic hammock for babies that can be activated and controlled electronically. The child can be placed securely in the hammock and softly rocked to sleep, without manual application. The hammock provides a soothing motion that is helpful in lulling a baby to sleep. This idea is especially helpful for busy mothers who do not have enough hours in the day to keep up with all that motherhood entails.

It is then the principal object of the present invention to provide parents with a safe and convenient way to help their children sleep. The invention is designed to cull the babies via on the hammock via an electrical motor so that they fall asleep quickly and easily, thus freeing up time for the parents and ultimately making the entire family happy and rested.

It is a secondary objective of the present invention to provide for an ornamental household article that is pleasant to see and display.

It is an additional objective of the present invention to provide a device that does not rust, or deteriorates over time. It is a final objective of the present invention to provide for a device that is cheap to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

Figure 1:
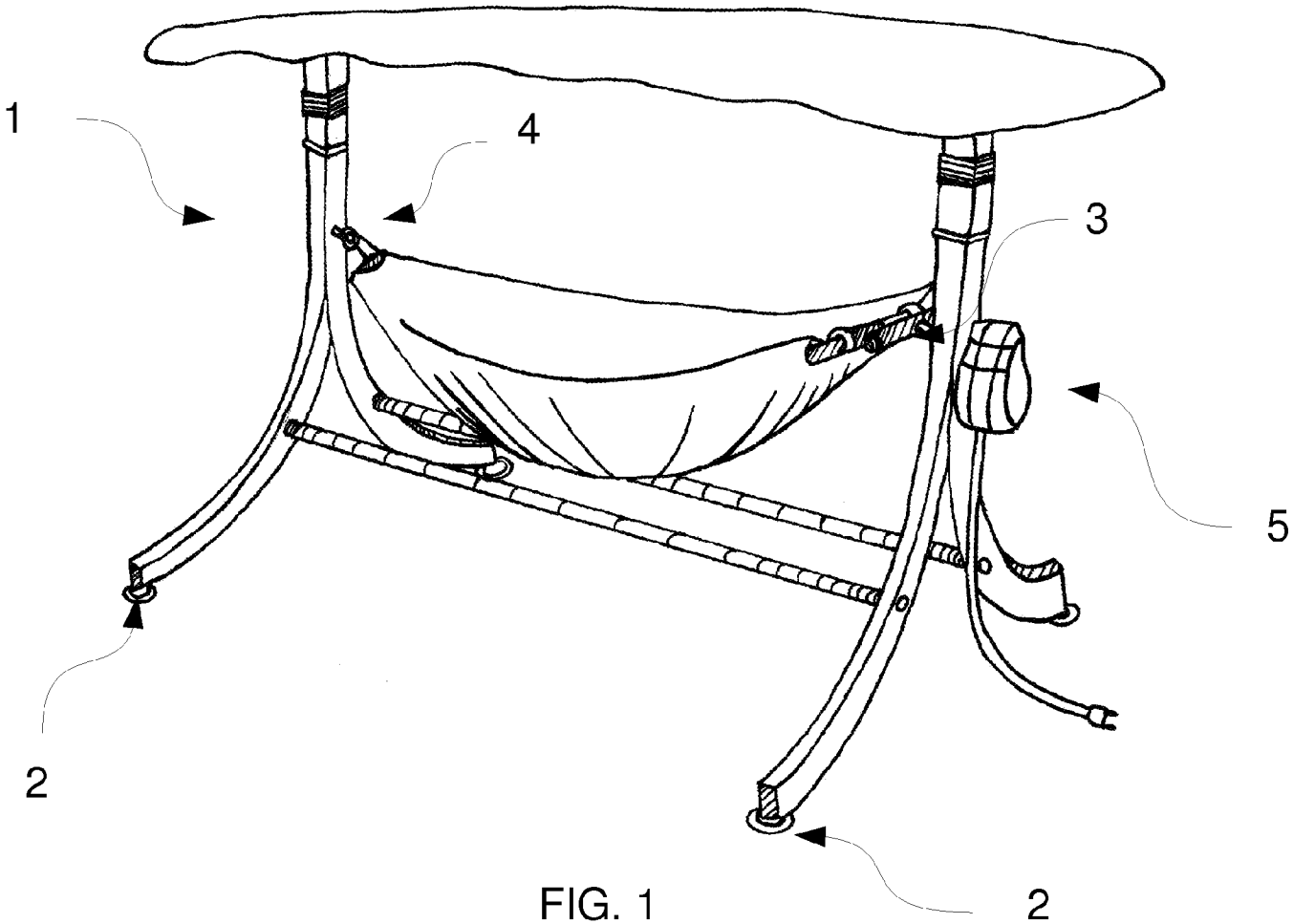
FIG. 1 is a perspective view of "Rock-a-Bye Hammock" in accordance with the teachings of the present invention.
Figure 2:
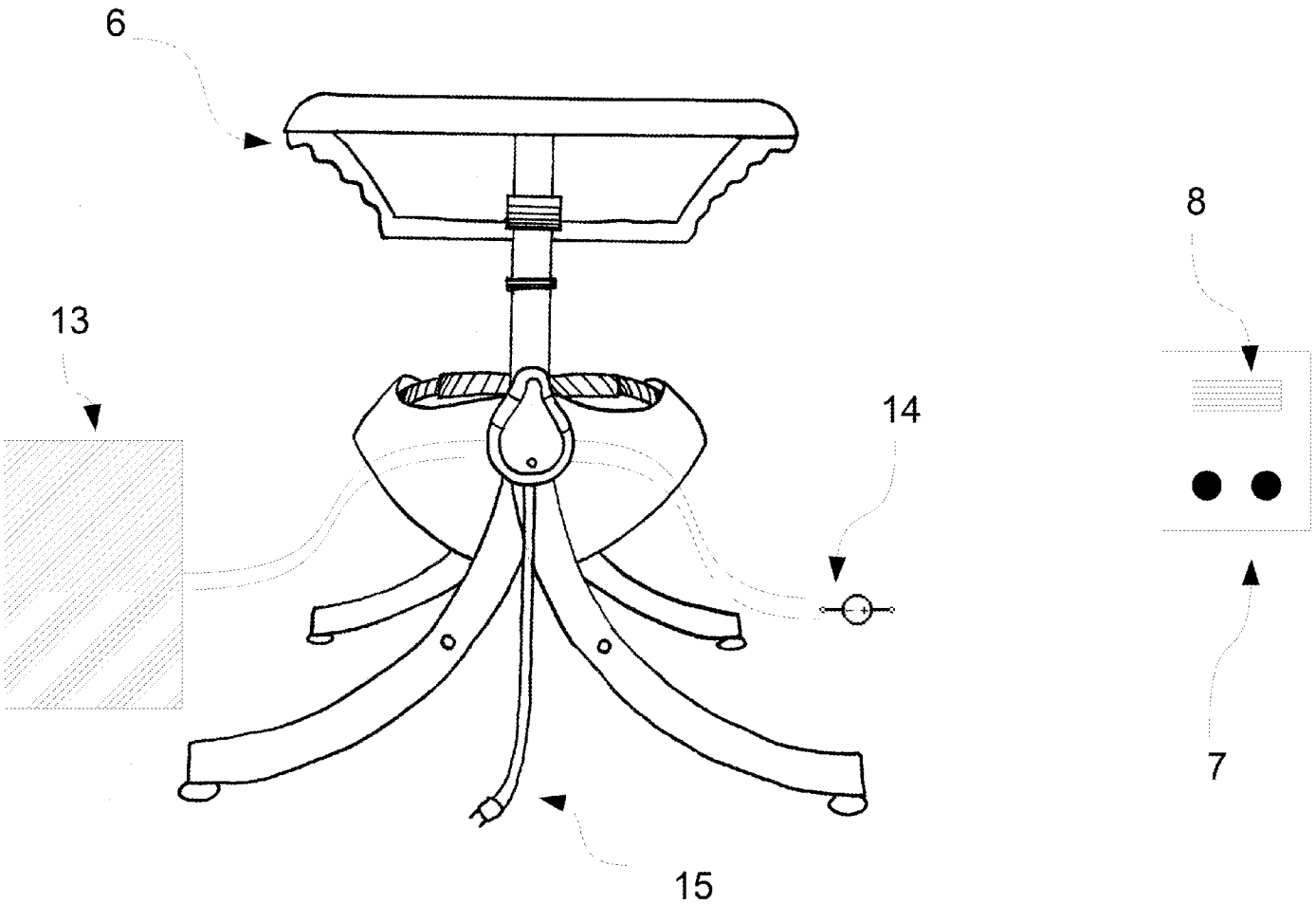
FIG. 2 is a side perspective view of "Rock-a-Bye Hammock" of FIG. 1 and all its features including a roof cover.
Figure 3:
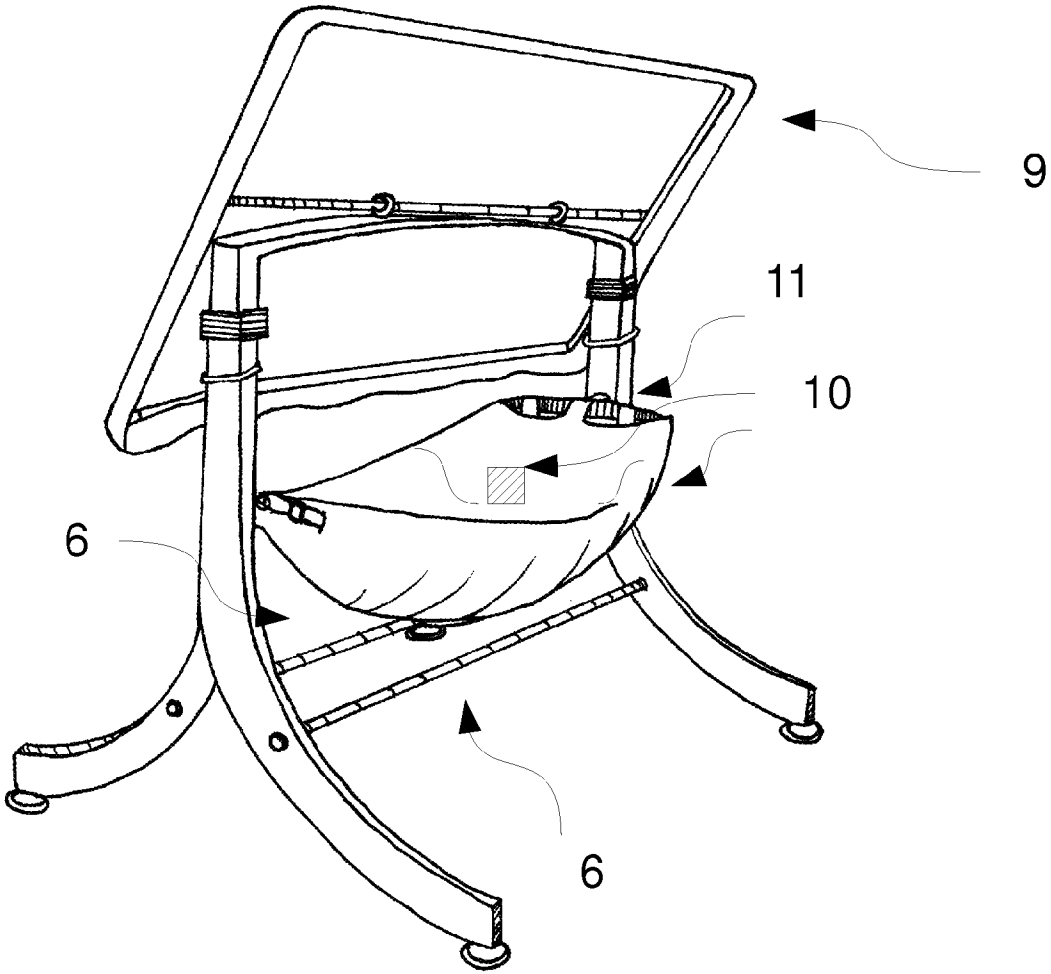
FIG. 3 is a left perspective view of "Rock-a-Bye Hammock" of FIG. 1.
Figure 4:
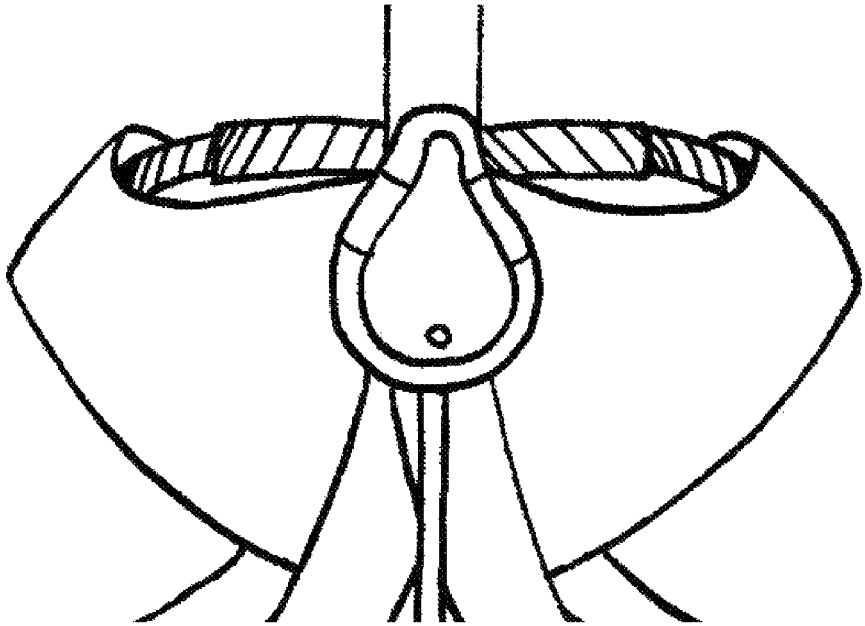
FIG. 4 is a detail rear view of the "Rock-a-Bye Hammock" of FIG. 1.

The inventor commonly refers to the device of the present invention as the "Rock-a-Bye Hammock". present invention is an automatic hammock for babies that can be activated and controlled electronically. When in use the child is placed securely in the hammock and softly rocked to sleep, without manual application. The hammock provides a soothing motion that is helpful in lulling a baby to sleep.

As it can bee seen from the figures essential elements of the motorized hammock object of the present invention include: a base stand generally describing the shape of an inverted U (1), mounted on a plurality of feet (2); a rigid sling supporting an hammock seat (3), said sling having two ends a first end and a second end, said first end connected to a first vertical arm of the base stand via a free swinging bearing mechanism (4), said second end connected to a motor (5) installed on the opposite side of said base stand; and a main power source electrically connected with said motor. The motor is controlled by an ON/OFF switch connected via an electrical circuitry. In a separate embodiment of the present invention it is possible to remotely control the motor via a remote control (7), or a voice or light activated mechanism.

For example in the voice activated control, a microphone (8) capture the pulse generated in the air by the pronunciation of a plurality of pre set words. That pulse is processed via a CPU programmed with a voice recognition software that translates the pulse into an electric signal that ultimately activates the motion of the motor. Various commands can be programmed other than ON and OFF, such as Slow or Fast, with reference to the pace of the swinging, or slower and faster, respectively to increase or decrease the rate of the swinging action without fully stopping the swinging motion.

In one of the preferred embodiments of the present invention said motorized hammock further comprises a roof cover (9), that in a separate embodiment of the invention it is adjustable. Various materials can be used to built the rigid structures of the device object of the present invention such as: Aluminum, plastic polymers, metal alloys, and others.

Generally speaking the rigid components of the device including said base describing an inverted U, said plurality of feet, and said slings are attached to each other via adjustable joints that can either be made or plastic, metal, or metal alloys, or other suitable material.

The term alloy is used to describe a mixture of atoms in which the primary constituent is a metal. Because the percentage of each constituent can be varied, with any mixture the entire range of possible variations is called a system. In this respect, all of the various forms of an alloy containing only two constituents, like iron and carbon, is called a binary system, while all of the alloy combinations possible with a ternary alloy, such as alloys of iron, carbon and chromium, is called a ternary system. Examples of alloys include pewter, bronze, stainless steel, 14 carats gold, and brass.

Aluminum alloys are alloys in which the metal Aluminum (Al) is the predominant metal. The typical alloying elements are copper, magnesium, silicon and zinc. About 85% of Aluminum is used for wrought products, for example rolled plate, foils and extrusions. The most important cast Aluminum alloy system is Al—Si, where the high levels of silicon (4.0% to 13%) contribute to give good casting characteristics. Aluminum alloys are widely used in engineering structures and components where light weight or corrosion resistance is required and therefore are suitable for the structural material of the device of the present invention.

One notable Aluminum alloy is the Scandium-Aluminum alloy. The addition of scandium to Aluminum creates nanoscale $Al_3Sc$ precipitates which limit the excessive grain growth that occurs in the heat-affected zone of welded aluminium components. This has two beneficial effects: the precipitated $Al_3Sc$ forms smaller crystals than are formed in other Aluminum alloys and the width of precipitate-free zones that normally exist at the grain boundaries of age-hardenenable Aluminum alloys is reduced. Scandium is also a potent grain refiner in cast Aluminum alloys, and atom for atom, the most potent strengthener in Aluminum, both as a result of grain refinement and precipitation strengthening. Titanium based Aluminum alloys, which are stronger but heavier, are cheaper and much more widely used in commercial applications. The most efficient of metallic Aluminum-Scandium by weight is alloys contain between 0.1% and 0.5% (by weight) of scandium.

In a separate embodiment of the device of the present application the motorized hammock of claim one whereas said baby hammock is made of a fire retardant or fire resistant fabric that can also be safely washed in a commercial laundry machine (i.e. the fabric material is washable). Examples of fire retardant material that could be used for the fabric of the hammock, include but are not limited to: Twaron, TARAMID (a TARASafe trademark), NEMEX (a DuPont trademark), ARSELON-(Khimvolokno trademark), coated nylon, Carbon Foam, M5 fiber, Kevlar, TARACOMFORT (a TARASafe trademark), Proban fr cotton, PYROMEX (a trademark of Toho Tenax), Pyrovatex fr cotton, Dale Antiflame, Indura fr cotton, Technora, Teijinconex, Lenzing FR (fire retardant Rayon), Carbon X, Kanox, Mazic, Modacrylic, Kermel, PBI, and Benchmark FR. NEMEX, ARSELON, TARACOMFORT, and PYROMEX are trade marks registered with the USPTO and will not be used in a negative or disparaging way in the course of the present application.

Various straps and belts (10) placed in the body of the hammock are designed to keep the body of the child in place. The hammock itself is made by a flame retardant, washable material and hold onto the rigid structures either via sturdy clips (11), zippers, or a plurality of VELCRO® straps.

VELCRO is a Registered Trademark (RT) with the USPTO directed to "All-purpose straps also including hook and loop fasteners, all sold as a unit" belonging to: Velcro Industries, a Limited Liability Company with its main office in Curacao in the Netherlands Antilles and will not be used in a negative or disparaging way in the course of the present application.

Power to the swinging motor is supplied by an electrical power supply such as a power cord (15) attached to an electrical outlet. Alternatively the motorized hammock of can draw electrical power from a solar panel (13) that convert via a photovoltaic process light (radiative) energy into electrical energy, or from both. A battery bank (14) can also be used as a secondary power source. Glass math batteries have historically shown good results when coupled with solar panels.

the Rock-a-Bye Hammock is mounted on an aluminum base with rods on opposite ends to support the hammock. For convenience, the hammock is attached with sturdy clips to allow for removal and washing purposes. An electrical motor will swing the hammock at variable speeds in back-and-forth motion. An awning is also attached overhead to keep the child in his or her own restful world with fewer distractions. The awning is also helpful as protection from the sun if this product is utilized outdoors. The awning is provided by an electrical motor powered by electricity from a power outlet. The motor is fastened to the body of the hammock.

Some of the materials considered for the manufacturing could be, but are not limited to, aluminum or light weight steel for the base. Materials for constructions include but are not limited to wood, wool, lead, aluminum, plastic, glass, ropes, cotton, fleece, micro fiber, or any other similar materials. Basic components are roof cover, motor, feet, hammock, and a power cord.

In a further embodiment of the device disclosed in the present application distance holder (spacers) (6) may be inserted to help maintaining the distance between the "legs" described by the downcoming sides of the inverted U base member. As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A remotely voice controlled motorized hammock comprising: a base stand generally describing the shape of an inverted U, mounted on a plurality of adjustable feet; a rigid sling supporting a hammock seat equipped with a plurality of straps and belts to keep the body of the child in place; said sling having two ends a first end and a second end, said first end connected to a first vertical arm of the base stand via a free swinging bearing mechanism, said second end connected to a motor installed on the opposite side of said base stand; a main power source electrically connected with said motor, a solar panel electrically connected with said motor, and a roof cover; a remotely controlled ON/OFF switch, and a voice activated remote control.

2. The remotely voice controlled motorized hammock of claim one further comprising a glass math battery combined with said solar panel.

3. The remotely voice controlled motorized hammock of claim one where said roof cover is adjustable.

4. The remotely voice controlled motorized hammock of claim one where said base describing an inverted U, said plurality of feet, and said slings are made of Aluminum.

5. The remotely voice controlled motorized hammock of claim one where said base describing an inverted U, said plurality of feet, and said rigid slings are made of a plastic polymer.

6. The remotely voice controlled motorized hammock of claim one where said base describing an inverted U, said plurality of feet, and said rigid slings are made of a metallic alloy containing Aluminum.

7. The remotely voice controlled motorized hammock of claim one where said base describing an inverted U, said plurality of feet, and said rigid slings are made of a metallic alloy containing Iron.

8. The remotely voice controlled motorized hammock of claim one where said base describing an inverted U, said plurality of feet, and said rigid slings are attached to each other via adjustable joints.

9. The remotely voice controlled motorized hammock of claim eight where said adjustable joints are made of plastic.

10. The remotely voice controlled motorized hammock of claim eight where said adjustable joints are made of a metallic alloy.

11. The remotely voice controlled motorized hammock of claim ten where said metallic alloy is the Scandium-Aluminum alloy.

12. The remotely voice controlled motorized hammock of claim one whereas said baby hammock is hold onto the rigid structure described by the U shaped base, the feet, and the rigid sling, by a plurality of sturdy clips.

13. The remotely voice controlled motorized hammock of claim one whereas said hammock-seat is made of a fire retardant fabric.

14. The remotely voice controlled motorized hammock of claim one whereas said hammock-seat is made of a machine washable fabric.

15. The remotely voice controlled motorized hammock of claim one further comprising distance holder, or spacers inserted between the downcoming sides of said inverted U base stand.

16. The remotely voice controlled motorized hammock of claim one whereas said voice activated remote control further comprises a microphone to capture the pulse generated in the air by the pronunciation of a plurality of pre set words; a CPU programmed with a voice recognition software that translates said pulse into an electric signal that ultimately activates the motion of the motor.

17. The remotely voice controlled motorized hammock of claim 16 where said pre set words are selected from the group consisting of ON, OFF, Slow, and Fast.

* * * * *